United States Patent [19]

Ma

[11] Patent Number: 4,674,522

[45] Date of Patent: Jun. 23, 1987

[54] HOISTING MECHANISM

[76] Inventor: Mark J. S. Ma, 12th Floor, 578 Kwang Fu South Rd., Taipei, Taiwan

[21] Appl. No.: 861,852

[22] Filed: May 12, 1986

[51] Int. Cl.[4] ..... A45B 17/00

[52] U.S. Cl. ..... 135/20 M

[58] Field of Search ..... 135/20 M, 20 R, 25

[56] References Cited

U.S. PATENT DOCUMENTS

| | | | |
|---|---|---|---|
| 2,595,697 | 5/1952 | Pereira . | |
| 2,863,466 | 12/1958 | Small | 135/20 M |
| 2,951,492 | 9/1960 | Small | 135/20 M |
| 3,145,720 | 8/1964 | Torii | 135/20 M |
| 3,182,673 | 5/1965 | Small | 135/20 M |
| 3,311,119 | 3/1967 | Pearlstine | 135/20 M |
| 3,419,295 | 12/1968 | Small | 135/20 M |
| 3,521,651 | 7/1970 | Pearlstine | 135/20 M |

*Primary Examiner*—J. Karl Bell

*Attorney, Agent, or Firm*—Sandler & Greenblum

[57] ABSTRACT

An apparatus for pivoting a support at a joint connected to sections of a support rod. The joint includes an upper member provided with a narrow lower end portion having teeth around a curved surface which engage a threaded portion of a shaft rotatably mounted in a lower member of the joint. The rotatable shaft is provided at one end with a bevelled gear having teeth which engage teeth on a bevelled tooth drive wheel coaxially attached to a drive shaft so that the rotation of the drive shaft is transmitted through this assembly to cause the upper member of the joint to pivot.

8 Claims, 5 Drawing Figures

HOISTING MECHANISM

BACKGROUND OF THE INVENTION

1. Field of the Invention

The present invention relates to mechanisms for hoisting or other wise lifting or moving objects a certain distance. In particular, the hoisting mechanism of the present invention is suitable for hoisting flags, awnings, canopies and the like and especially the canopy of an umbrella.

2. Discussion of Background and Material Information

Conventional umbrellas provided with large canopies, such as garden or beach umbrellas, employ equipment for hoisting the canopy which is usually fastened in a lower area of the support rod. In such cases, the devices used to hoist the umbrella typically include a flexible cable or rope attached at one end to a spool of a reel with another end of the cable attached to a runner slideable mounted on the support rod to which braces are attached at one end, with another end of the braces being pivotally attached to connections which are usually fixed along a middle portion of frame ribs which support the canopy when the umbrella is opened. More recently, it has been proposed to string the flexible cable or rope from the spool over an appropriate pulley-type device, preferably including a guide wheel, positioned above the runner in an upper section of the support rod, and then back to the runner. In operation, as the spool of the reel is rotated, the flexible cable or rope is wound on the spool and exerts a pulling action on the runner causing it to slide upwardly towards the crown of the umbrella until the braces have fully extended to force the frame ribs outwardly to stretch the canopy to a fully open condition.

Such mechanisms may also be used to hoist the canopy of large umbrellas where the support rod is divided into upper and lower shaft sections mounted for pivotable movement relative to each other around a joint, hinge or similar device suitable for this purpose. In this type of arrangement, the reel is continuously rotated after the umbrella canopy has been fully opened so as to exert a pulling force on the upper shaft section causing it to pivot about the joint to adjust the position of the canopy to a desired angle.

The prior art mechanisms used to accomplish hoisting and adjusting the position of the canopy to a desired angle, however, suffer from numerous shortcomings. For example, after the umbrella canopy has been completely opened, the reel continues to be rotated to pivot the upper section of the shaft to a desired angle. During this manipulation, the reel mechanism and shaft experience two different tension forces. Consequently, different torsional forces must be used when cranking the reel during the opening and adjusting of the umbrella canopy. The shortcomings and disadvantages of such prior art mechanisms include the fact that once the umbrella canopy is opened, it becomes considerably more difficult to exert the forces during the winding of the reel necessary to cause the upper section of the shaft to pivot to the desired angle. In addition, because of the extreme tension which is experienced by the rope as the upper section of the support rod is pivoted, there is an increased chance that the rope will break. Even if this does not occur, the rope tends to become dislodged from the guide wheel of the pulley-type arrangement around which it is strung as a result of the increased torsional forces to which the rope is subjected during the second stage of the procedure.

The present invention provides a solution to these problems with the provision of a novel and unique hoisting device which does not require a flexible cable or rope to accomplish hoisting the canopy and pivoting the upper section of the support rod. The improvement of the apparatus of the present invention is an arrangement of gears, drive wheels, a track and related elements whereby different torsional forces are effected during the manipulations of opening the umbrella canopy and adjusting the angle of the canopy of the umbrella, respectively. As further described in detail below, the hoisting mechanism may be designed so that additional tension experienced as the drive shaft continues to be rotated to cause desired pivoting of the upper section of the shaft to adjust the angle of the canopy after the mechanism has been manipulated so as to fully open the umbrella is minimized.

SUMMARY OF THE INVENTION

The present invention relates generally to an apparatus for pivoting an elongate element at a joint. In particular, the apparatus of the present invention includes a pivotable joint made up of a first member having a generally elongate end portion adapted to be connected to a lower end of an upper support, and an opposite narrow end portion defined by an arcuate surface provided with teeth and having a transverse opening through the end portion; a second member having a hollow portion defined by an elongate wall adapted to be connected to an upper end of a lower support and an opposite slotted end portion for receiving the narrow end portion of the first member which has openings that align with the opening of the narrow end portion of the first member when received in the slotted end portion of the second member; a pin passing through the opening so as to pivotably connect the first member with the second member; and an axle mounted for rotation transversely across the hollow member and being provided with a spool or protuberance having teeth coaxially attached to the axle and positioned so as to engage the teeth on the arcuate surface of the narrow end portion of the first member of the joint, and an end extending through the elongate wall provided with a coaxially attached transmission gear adapted to be connected to a power source, preferably by engaging teeth of a drive wheel which is operably connected to a power source; a lower support having an upper end connected to the hollow portion of the second member and an elongate surface provided with an axially positioned toothed track; a sleeve connected to the mechanism coaxially positioned to move longitudinally along the elongate surface of the lower support and including a casing for housing the mechanism, a drive shaft mounted for rotation in the housing disposed transverse to the axis of the lower support and generally perpendicular to the axle and having a first toothed wheel for imparting translational movement to the sleeve coaxially attached to the drive shaft so as to engage the toothed track of the lower support, and a second toothed drive wheel coaxially attached to the drive shaft so as to engage the transmission gear when the sleeve has been moved into position adjacent the joint.

The apparatus of the present invention preferably also includes in an upper support having an elongate surface wherein the lower end is connected to the elongate portion of the first member of the joint and an abutment is mounted on the elongate surface so as to define a predetermined distance from the pin pivotally connecting the first member and the second member of the joint together, preferably wherein this predetermined distance equals said length of the sleeve, with the abutment preferably being a slide mounted to move axially along a portion of the elongate surface and stop at a location to define the predetermined distance. The apparatus of the present invention preferably includes a canopy attached at the top of the upper support, wherein the slide is operably connected with the canopy so as to cause the canopy to open as the slide is moved towards the top of the upper support and to close as the slide is moved in the opposite direction.

The apparatus of the present invention is also directed to a pivotal joint including a first member having a generally elongate portion adapted to connected to an element and an opposite narrow end portion defined by an arcuate surface provided with teeth and having a transverse opening, a second member having a hollow portion defined by an elongate wall adapted to be connected to another element and an opposite slotted end portion for receiving the narrow end portion of the first member and having openings which align with the opening through the narrow end portion of the first member when received in the slotted end portion of the second member, and a pin passing through the opening so as to pivotally connect the first member with the second member; and an axle mounted for rotation transversely across the hollow member, having a protuberance provided with teeth extending radially around a middle portion of the axle and positioned so as to engage the teeth on the arcuate surface of the narrow end portion of the first member of the joint, and an end extending through the elongate wall adapted to be connected to a power source.

The apparatus of the present invention is preferably an umbrella including a pivotal joint composed of a support having an upper end connected to a canopy, an elongate surface and a lower end portion, and a slide, operably connected to the canopy, mounted to move axially along a portion of the elongate surface to stop at a predetermined location; a pivotal joint including a first member having a generally elongate portion adapted to be connected to a lower end of the support and an opposite narrow end portion defined by an arcuate surface provided with teeth and having a transverse opening through the narrow portion, a second member having a hollow portion defined by an elongate wall adapted to be connected to an upper end of a lower support and an opposite slotted end portion for receiving the narrow end portion of the first member and having openings which align with the opening through the narrow end portion of the first member when received in the slotted end portion of the second member, and a pin passing through the opening so as to pivotally connect the first member with the second member; and an axle mounted for rotation transversely across the hollow member, having a protuberance provided with teeth extending radially around a middle portion of said axle and positioned so as to engage the teeth on the arcuate surface of the narrow end portion of the first member of the joint, and an end extending thrugh said elongate wall provided with a coaxially attached transmission gear adapted to engage teeth of a drive wheel; a lower support having an upper end connected to the hollow portion of the second member and an elongate surface provided with an axially positioned track, a sleeve having a length operably connected to a mechanism coaxially positioned to move axially along the elongate surface of the lower support, wherein the mechanism includes a casing for housing the mechanism pivotally attached to the sleeve, a drive shaft mounted for rotation in the housing disposed transverse to the axis of the lower support and generally perpendicular to the axle having a first toothed wheel for imparting translational movement to the sleeve coaxially attached to the drive shaft so as to engage the toothed track of the lower support, a second toothed drive wheel coaxially attached to the drive shaft so as to engage the transmission gear when the mechanism has been moved into position adjacent the joint, wherein said length of the sleeve is the same as the distance between the slide when stopped at the predetermined location from the pin.

BRIEF DESCRIPTION OF THE DRAWINGS

The present invention will now be described with reference to the accompanying drawings wherein like reference characters designate like or corresponding parts throughout several views, in which.

DETAILED DESCRIPTION

Figure 5:
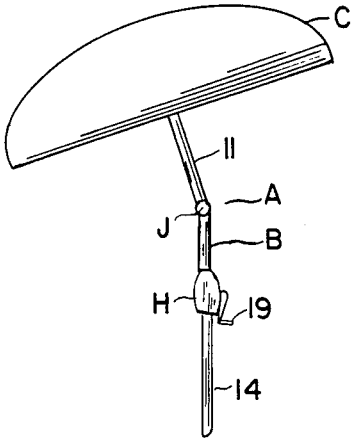
FIG. 5 is a side view of the general structure of an umbrella equipped with the hoisting device of the present invention.

The general structure of an umbrella embodying the novel hoisting device of the present invention is shown in FIG. 5. Although illustrated as a garden-type umbrella, generally designated as element A, the umbrella may be of any type that includes a central support rod, shaft or pole, generally indicated as element B having an upper section of rod, generally indicated as element 11, which is attached at the top to a frame assembly of ribs and braces (not shown) which support the canopy, generally indicated as element C. The umbrella is opened by sliding a runner 16 to which the braces (not shown) are connected upwardly towards the top of the umbrella, and is closed by sliding the runner in a reverse direction. The umbrella support B is preferably a tubular structure made from metallic, plastic or other materials suitable for this purpose. Although the hoisting device of the present invention could be modified for use in conjunction with an umbrella mounted on a unitary shaft, the hoisting device finds particularly utility when used in conjunction with a multi-sectional support wherein the upper section 11 of the support is adapted to be pivotaly connected to a middle or lower section of support 14 by means of a joint, generally designated as element J, and described in more detail below, suitable for pivoting an upper section of the support relative to a lower section of the support. In the case of a multi-sectional support, the hoisting device of the present invention is moveably mounted on the section of the support positioned immediately below the joint J. In the embodiment shown in FIG. 5, the hoisting device of the present invention, generally designated as H, is provided with a handle or cranked 19, and is mounted to the lower section of the support for the canopy C of the umbrella.

Figure 1:
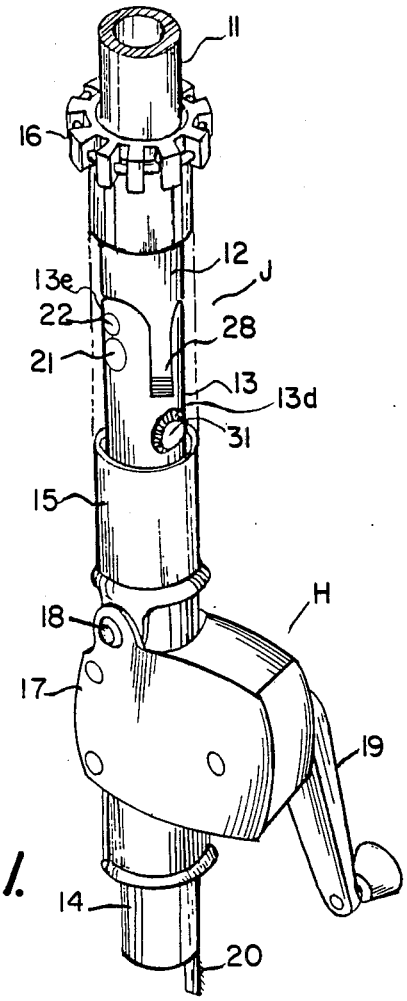
FIG. 1 is a perspective view showing the pivotal joint assembly and associated reel mechanism of the present invention.
Figure 2:
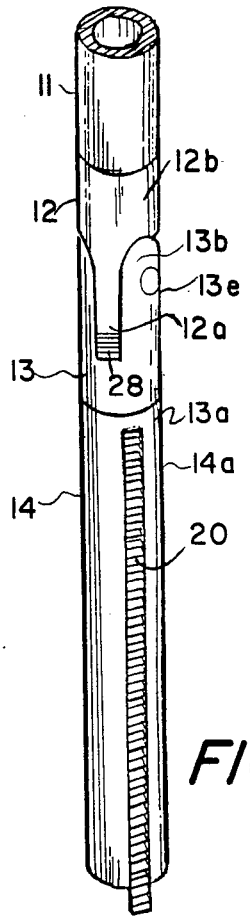
FIG. 2 is a perspective view of the joint assembly and lower support section taken from a different angle to show a toothed track provided longitudinally along the exterior surface of the lower support rod.
Figure 4:
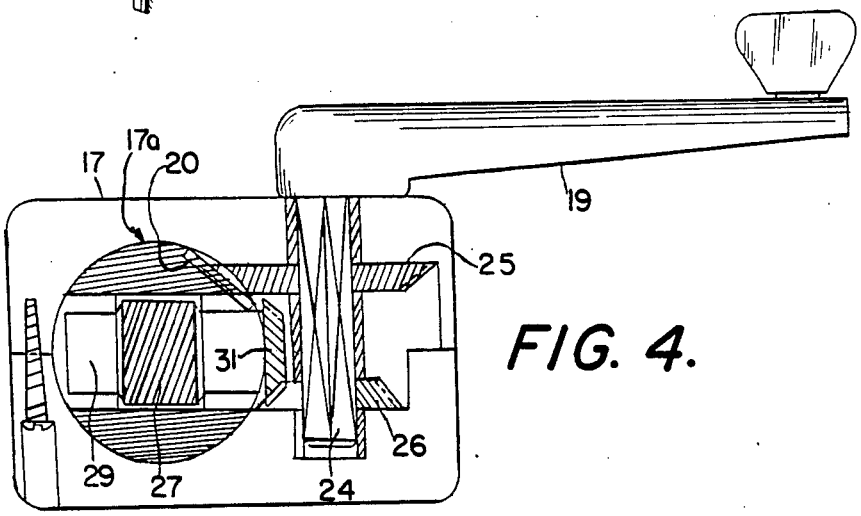
FIG. 4 is a cross-sectional view of the arrangement shown in FIG. 3.

Referring now to FIGS. 1 and 2, the support B and joint assembly J is shown in more detail. The lower section of the support rod 14 is shown as being provided with a track of teeth 20 which are engaged by the teeth of drive wheel 25, as shown in FIG. 4 and described in more detail below. The upper end 14*a* of lower section 14 of the support is fitted or otherwise attached to a lower hollow end portion 13*a* of lower member 13 of joint J. Lower member 13 of the joint assembly includes a slotted upper portion 13*b* having a generally U-shaped configuration with upwardly extending arms at its opposite end having openings 13*c* provided in the arms and is thus adapted to receive lower narrow end portion 12*a* of upper member 12 of joint J. As shown more clearly in FIG. 3, the end surface of narrow end portion 12*a* is curved and is provided with teeth 28 along a section of its arcuate surface which engage the threads provided on spool 27 rotatably mounted within the lower hollow end portion 13*a* of lower member 13 of the joint assembly, as described in more detail below. The upper end portion 12b of upper member 12 is similarly fitted or attached to upper section 11 of the support rod.

Figure 3:
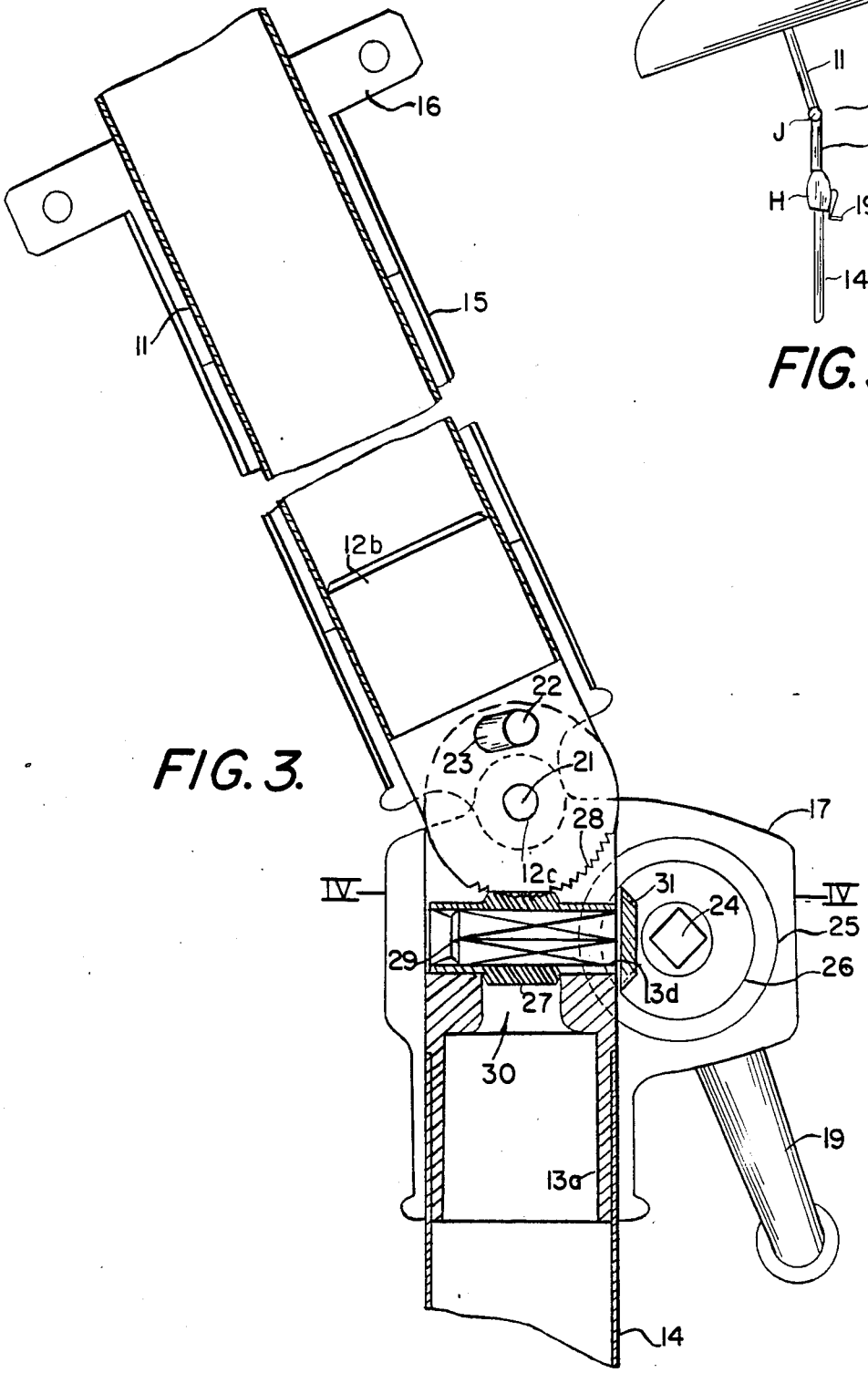
FIG. 3 is a side view taken in cross-section showing the reel mechanism positioned adjacent the joint assembly.

Referring now to FIG. 3, the assembly of the upper member 12 and lower member 13 of joint J is shown in more detail. In this regard, hollow end portion 13*a* is shown as extending to fit or nest within lower section 14 of the support rod and is shown as being provided with an opening or cavity 30 sized to permit threaded protrusion or spool 27 integral with or attached to axle or shaft 29 to rotate in the space provided by the opening. As shown, the sides of hollow end portion 13*a* extend inwardly as shoulders to form an opening 30 which has a diameter narrower than the diameter between the walls of hollow end portion 13*a* which nests within lower section 14 of the support rod so as to provide a seat for shaft 29 which is disposed transverse to the axis of lower member 13 of joint J. Although lower section 13*a* is shown as being hollow, lower section 13*a* may be solid so long as a cavity 30 is provided in its upper end to permit the rotation of threaded portion 27 of shaft 29. One end of shaft 29 extends through an opening 13*c* in lower member 13 of joint J and is attached to a coaxially mounted gear 31 having bevelled teeth adapted to engage the teeth of bevelled drive wheel 26 as described in more detail below. The curved lower end surface of narrow end portion 12*a* is provided with teeth 28 which engage threaded portion 27 of shaft 29 when the upper member 12 and lower member 13 of joint J are fitted together. The lower curved surface of narrow end portion 12*a* is preferably semi-circular in shape, as shown, and is provided with a transverse opening 12*c* positioned at the center of the radii of the semi-circular shaped end portion. When upper member 12 and lower member 13 of joint J are fitted together, opening 12*c* in narrow end portion 12*a* of upper member 12 align with the openings 13*c* in the arms of upper slotted portion 13*b* of lower member 13 of joint J so as to receive pin 21 which is passed therethrough to pivotably connect upper member 12 and lower member 13 of joint assembly J together.

One of the arms of the upper slotted portion 13*b* is provided with an opening 13*e* in which a locking pin 22 can be inserted. Related to this, a lateral surface of narrow end portion 12*a* which faces the arm of upper slotted portion 13*b* in which locking pin 22 is inserted is provided with at least one curved slot spaced diametrically opposite the arcuate surface having teeth 28 so as to receive locking pin 22. Pin 22 serves to lock the joint assembly in a predetermined position. If only one slot 23 is provided, the upper member 12 and lower member 13 may be locked in position so as to have a common axis or slot 23 may serve as a guide to define the extent of pivotal movement of the joint assembly depending upon the length of the slot. In the latter instance, the length of curved slot 23 should be such that it limits the pivotal movement of upper member 12 of the joint assembly to an angle less than or corresponding to the section of narrow end portion 13*a* having teeth so that threaded portion 27 of shaft 29 and teeth 28 of narrow end portion 12*a* do not become disengaged. If a number of slots are provided, however, the joints may be locked into position at preselected angles depending upon the particular location of the slot provided on the lateral surface of narrow end portion 12*a* of upper member 12 of joint J.

The bevelled gear 31 is attached at the head end of rotatable shaft 29 so as to engage bevelled drive wheel 26 coaxially mounted for rotation with drive shaft 24 which is adapted to be connected to a power source, shown as crank or handle 19, to impart rotational movement thereto. The drive shaft 24 and coaxially mounted bevelled drive wheel 24 and bevelled drive wheel 25 are rotatably mounted within a housing 17 having an opening or bore positioned and sized so as to slide along lower section 14 of the support rod. The housing 17 may be provided with a lower extension 17*b* having an interior bore corresponding in size and shape to the interior bore of housing 17. The lower extension 17*b* may be integral with or attached to housing 17 preferably so that the interior bore of extension 17*b* is axially aligned with the interior bore 17*a* of housing 17. The housing 17 is also provided with an upper extension 15 having an interior bore having a size and shape sufficient to slide over upper member 12 and lower member 13 of joint assembly J and associated elements which may protrude from the exterior surface thereof. In FIG. 1, upper extension 15 is shown to be axially aligned with opening 17*a* and the interior bore of lower extension 17*b* of housing 17, but is attached to housing 17 by means of linking pins 18 so as to permit upper extension 15 to pivot with respect to casing 17. The upper section 11 of the support rod has a runner 16 coaxially mounted so as to be slideable on upper section 11 of the support rod.

As discussed above, ends of braces (not shown) whose opposite ends are attached to frame ribs which support the canopy of an umbrella are attached in a conventional manner to runner 16 which is slid upwardly towards the crown of the umbrella when pushed by upper extension 15 as a result of the action of rotatable drive shaft 24 and the arrangement of toothed drive wheel 25 and toothed track 20. In this regard, housing 17 is mounted in such a way that toothed drive wheel 25 engages the teeth of track 20 positioned axially along the exterior surface of lower section 14 of the support rod so that housing 17 and its attached upper extension 15 climb upwardly as drive shaft 24 is rotated until drive wheel 25 reaches the end of track 20. Although not drawn to scale upper extension 15 has a length sufficiently long so that the upper end of extension 15 comes into contact with runner 16 before drive wheel 25 reaches the end of track 20. After this occurs, extension 15 pushes runner 16 upwardly towards the crown of the umbrella as casing 17 is slid upwardly as a result of the action of drive shaft 24 on drive wheel 25 which climbs upwardly along toothed track 20. The length of extension 15 is such that when drive wheel 25 reaches the end of track 20, runner 16 has been pushed upwardly to a sufficient extent to fully open the canopy of the umbrella. In this position, linking pin 18 is aligned with pin 22 which passes through openings 13*c* in lower member 13 and opening 12*c* in upper member 12 of joint assembly J so that joint assembly J is free to pivot around pin 21. In addition, bevelled drive wheel 26 is brought into engagement with bevelled gear 31 attached to shaft 29 provided with threaded protuberance or spool 27 which engages teeth 28 along the lower curved surface of narrow end portion 12*a* of upper member 12 of joint J. Inasmuch as drive wheel 25 is at the end of track 20, no further upward movement is imparted to casing 17 by continued rotation of drive shaft 24 which is now transmitted to shaft 29 by the engagement between the teeth of bevelled drive wheel 26 and the teeth of bevelled gear 29. As shaft 29 rotates, the threads of protuberance 27 which engage teeth 28 of narrow end portion 12*a* of upper member 12 of joint assembly J cause upper member 12 of joint assembly J to pivot about pin 21 thereby causing the canopy of the umbrella to be adjusted to a desired angle. In order to return upper section 11 of the support rod to its upright position and to close the umbrella, drive shaft 24 is rotated in the opposite direction to climb down track 20.

From the foregoing description, one skilled in the art can easily ascertain the essential characteristics of this invention and, without departing from the scope thereof, can make various changes and modification of the invention to adapted to various usages and conditions.

I claim:

1. An apparatus including pivotal joint, said apparatus comprising:

(a) a pivotal joint including:

(i) a first member having a generally elongate portion adapted to be connected to a lower end of an upper support and an opposite narrow end portion defined by an arcuate surface provided with teeth and having a transverse opening through said end portion;

(ii) a second member having a hollow portion defined by an elongate wall adapted to be connected to an upper end of a lower support and an opposite slotted end portion for receiving said narrow end portion of the first member and having openings which align with said opening through said narrow end portion of the first member when received in said slotted at end portion of the second member;

(iii) a pin passing through said opening so as to pivotably connect said first member with said second member; and (iv) an axle mounted for rotation transversely across said hollow member, said axle having a protuberance provided with teeth extending radially around a middle portion of said axle and positioned so as to engage said teeth on the arcuate surface of the narrow end portion of the first member of the joint, and an end extending through said elongate wall provided with a coaxially attached transmission gear adapted to engage teeth of a drive wheel;

(b) a lower support having an upper end connected to said hollow portion of said second member and an elongate surface provided with an axially positioned track;

(c) a sleeve having a length operably connected to a mechanism coaxially positioned to move axially along said elongate surface of the lower support, said mechanism including:

(i) a casing for housing said mechanism pivotally attached to said sleeve;

(ii) a drive shaft mounted for rotation in said housing disposed transverse to the axis of said lower support and generally perpendicular to said axle having:

(1) a first toothed wheel for imparting translational movement to said sleeve coaxially attached to said drive shaft so as to engage said toothed track of the lower support;

(2) a second toothed drive wheel coaxially attached to said drive shaft so as to engage said transmission gear when said mechanism has been moved into position adjacent said joint.

2. The apparatus in accordance with claim 1, comprising:

(d) an upper support having an elongate surface wherein said lower end is connected to said elongate portion of the first member of the joint; and (e) an abutment mounted on said elongate surface to define a predetermined distance from said pin pivotally connecting the first member and the second member of the joint together.

3. The apparatus in accordance with claim 2 wherein said predetermined distance equals said length of the sleeve.

4. The apparatus in accordance with claim 3, wherein said abutment is a slide mounted to move axially along a portion of said elongate surface and stop at a location to define said predetermined distance.

5. The apparatus in accordance with claim 4, comprising:

(f) a canopy attached at the top of said upper support, wherein said slide is operably connected with said canopy so as to cause said canopy to open as said slide is moved towards the top of the upper support and to close as said slide is moved in the opposite direction.

6. The apparatus in accordance with claim 5, wherein said apparatus is an umbrella.

7. A pivotal joint comprising:

(a) a first member having a generally elongate portion adapted to connected to an element and an opposite narrow end portion defined by an arcuate surface provided with teeth and having a transverse opening through said end portion;

(b) a second member having a hollow portion defined by an elongate wall adapted to be connected to another element and an opposite slotted end portion for receiving said narrow end portion of the first member and having openings which align with said opening through said narrow end portion of the first member when received in said slotted end portion of the second member;

(c) a pin passing through said opening so as to pivotally connect said first member with said second member; and (d) an axle mounted for rotation transversely across said hollow member, said axle having a protuberance provided with teeth extending radially around a middle portion of said axle and positioned so as to engage said teeth on the arcuate surface of the narrow end portion of the first member of the joint, and an end extending through said elongate wall adapted to be connected to a power source.

8. An umbrella including a pivotal joint comprising:

(a) a support having an upper end connected to a canopy, an elongate surface and a lower end portion;

(b) a slide mounted to move axially along a portion of said elongate surface to stop at a predetermined location, said slide being operably connected to said canopy;

(c) a pivotal joint including:

(i) a first member having a generally elongate portion adapted to be connected to a lower end of said support an an opposite narrow end portion defined by an arcuate surface provided with teeth and having a transverse opening through said narrow portion;

(ii) a second member having a hollow portion defined by an elongate wall adapted to be connected to an upper end of a lower support and an opposite slotted end portion for receiving said narrow end portion of the first member and having openings which align with said opening through said narrow end portion of the first member when received in said slotted end portion of the second member;

(iii) a pin passing through said opening so as to pivotally connect said first member with said second member; and (iv) an axle mounted for rotation transversely across said hollow member, said axle having a protuberance provided with teeth extending radially around a middle portion of said axle and positioned so as to engage said teeth on the arcuate surface of the narrow end portion of the first member of the joint, and an end extending through said elongate wall provided with a coaxially attached transmission gear adapted to engage teeth of a drive wheel;

(b) a lower support having an upper end connected to said hollow portion of said second member and an elongate surface provided with an axially positioned track;

(c) a sleeve having a length operably connected to a mechanism coaxially positioned to move axially along said elongate surface of the lower support, said mechanism including:

(i) a casing for housing said mechanism pivotally attached to said sleeve;

(ii) a drive shaft mounted for rotation in said housing disposed transverse to the axis of said lower support and generally perpendicular to said axle having:

(1) a first toothed wheel for imparting translational movement to said sleeve coaxially attached to said drive shaft so as to engage said toothed track of the lower support; and (2) a second toothed drive wheel coaxially attached to said drive shaft so as to engage said transmission gear when said mechanism has been moved into position adjacent said joint, wherein said length of said sleeve is the same as the distance between said slide when stopped at said predetermined location and said pin.

* * * * *

UNITED STATES PATENT AND TRADEMARK OFFICE

CERTIFICATE OF CORRECTION

PATENT NO. : 4,674,522

DATED : June 23, 1987

INVENTOR(S) : Mark J.S. MA

It is certified that error appears in the above-identified patent and that said Letters Patent is hereby corrected as shown below:

At column 3, line 64 of the printed patent, "thrugh" should read ---through---.

At column 4, line 63 of the printed patent, "Pivotaly" should read ---Pivotally---.

At column 7, line 65 of the printed patent (i.e., in claim 1, line 23), "member" should read ---portion---.

At column 7, line 66 of the printed patent (i.e., claim 1, line 24), insert ---threaded--- before "protuberance".

At column 7, line 66 of the printed patent (i.e., claim 1, line 24), delete "provided with teeth".

At column 8, line 57 of the printed patent (i.e., claim 7, line 3), insert ---be--- before "connected".

At column 9, line 5 of the printed patent (i.e., claim 7, line 19), insert ---threaded--- before "protuberance".

At column 9, line 6 of the printed patent (i.e., claim 7, line 20), delete "provided with teeth".

At column 10, line 5 of the printed patent (i.e., claim 8, line 29), change "member" to ---portion---.

At column 10, line 6 of the printed patent (i.e., claim 8, line 30), insert ---threaded--- before "protuberance".

UNITED STATES PATENT AND TRADEMARK OFFICE

CERTIFICATE OF CORRECTION

PATENT NO. : 4,674,522

DATED : June 23, 1987

INVENTOR(S) : Mark J.S. MA

It is certified that error appears in the above-identified patent and that said Letters Patent is hereby corrected as shown below:

At column 10, line 6 of the printed patent (i.e., claim 8, line 30), delete "provided with teeth".

Signed and Sealed this

Ninth Day of February, 1988

*Attest:*

DONALD J. QUIGG

*Attesting Officer*

*Commissioner of Patents and Trademarks*